US010389021B1

(12) United States Patent
Thakur

(10) Patent No.: US 10,389,021 B1
(45) Date of Patent: Aug. 20, 2019

(54) ANTENNA PORTS DECOUPLING TECHNIQUE

(71) Applicant: Intel Corporation, Santa Clara, CA (US)

(72) Inventor: Jayprakash Thakur, Bangalore (IN)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/897,682

(22) Filed: Feb. 15, 2018

(51) Int. Cl.

| | |
|---|---|
| ***H01Q 1/24*** | (2006.01) |
| ***H01Q 1/52*** | (2006.01) |
| ***H01Q 5/335*** | (2015.01) |
| *H01Q 1/48* | (2006.01) |

(52) U.S. Cl.
CPC ..... *H01Q 1/521* (2013.01); *H01Q 5/335* (2015.01); *H01Q 1/243* (2013.01); *H01Q 1/48* (2013.01)

(58) Field of Classification Search
CPC ..... H01Q 1/521; H01Q 5/335; H01Q 1/243
See application file for complete search history.

(56) References Cited

U.S. PATENT DOCUMENTS

| | | | | |
|---|---|---|---|---|
| 5,877,727 | A | 3/1999 | Saitou et al. | |
| 7,916,089 | B2 | 3/2011 | Schlub et al. | |
| 8,094,079 | B2 | 1/2012 | Schlub et al. | |
| 8,854,266 | B2 | 10/2014 | Zhu et al. | |
| 9,799,953 | B2 | 10/2017 | Apaydin et al. | |
| 2003/0014766 | A1 | 1/2003 | Dinwiddie et al. | |
| 2006/0044196 | A1* | 3/2006 | Grant | H01Q 1/3275 343/713 |
| 2016/0013548 | A1* | 1/2016 | Park | H01Q 13/10 455/558 |
| 2016/0156110 | A1 | 6/2016 | Cohen et al. | |
| 2016/0285161 | A1 | 9/2016 | Apaydin et al. | |
| 2017/0084985 | A1* | 3/2017 | Ku | H01Q 1/243 |

FOREIGN PATENT DOCUMENTS

| | | |
|---|---|---|
| GB | 2551212 A | 12/2017 |

OTHER PUBLICATIONS

"Broadband vs. narrowband-Difference between broadband and narrowband." RF Wireless World, 4 pages.
What's the Difference Between Broadband and Narrowband RF Communications? Precision Clock Generator with square wave clocks to 2.05 GHzl Microwaves&Rf. 26 pages.
"Why does an Inductor Need a Fly-Back Diode?" West Florida Components. 3 pages.
International Search Report dated Apr. 5, 2019 for International Application No. PCT/US2019/013600.

* cited by examiner

*Primary Examiner* — Dieu Hien T Duong
(74) *Attorney, Agent, or Firm* — Eschweiler & Potashnik, LLC

(57) ABSTRACT

An antenna isolation circuit configured to provide an isolation between two adjacent antennas in a wireless communication device is disclosed. The antenna isolation circuit comprises a partition line circuit comprising a conductive element configured to be placed between the two adjacent antennas; and a matching circuit having a first end and a second end. In some embodiments, the matching circuit is coupled to the partition line circuit at the first end and to a ground circuit at the second end. In some embodiments, the matching circuit is configured to provide an impedance. In some embodiments, a dimension of the conductive element and the impedance of the matching circuit are configured to result in an isolation between the two adjacent antennas.

20 Claims, 7 Drawing Sheets

ANTENNA PORTS DECOUPLING TECHNIQUE

FIELD

The present disclosure relates to the field of antenna systems, and in particular to a method and an apparatus for providing isolation between antennas.

BACKGROUND

Advancement in cellular technology requires more antennas in order to support 5G, 4×4 long term evolution (LTE) multiple input and multiple output (MIMO), wireless local area network (WLAN), global navigation satellite system (GNSS) and other radios in a mobile phone, tablet and laptop etc. Supporting multiple antennas within a device is a major challenge due to the volume required for each of the antenna to achieve better performance. The antenna performance in term of return loss, bandwidth and efficiency is directly proportional to the volume allotted to the antenna and its location in a mobile device. The best performance is typically achieved when antenna is placed at periphery of the device. However, the Industrial Design (ID) of smartphones, tablets & laptops are moving towards minimizing bezel around the display and utilizing full metal bodies in order to reduce thickness of the device while maintaining mechanical strength and at the same time giving esthetic look to the ID. This trend in ID limits the space available for antennas to achieve good performance in modern mobile devices. It would be of great advantage if some of the antennas can share the same volume or placed closely and operate simultaneously without considerably affecting their performance. In this way, the total needed volume or space for the antennas in a device can be reduced.

BRIEF DESCRIPTION OF THE DRAWINGS

Some examples of circuits, apparatuses and/or methods will be described in the following by way of example only. In this context, reference will be made to the accompanying Figures.

DETAILED DESCRIPTION

Figure 1:
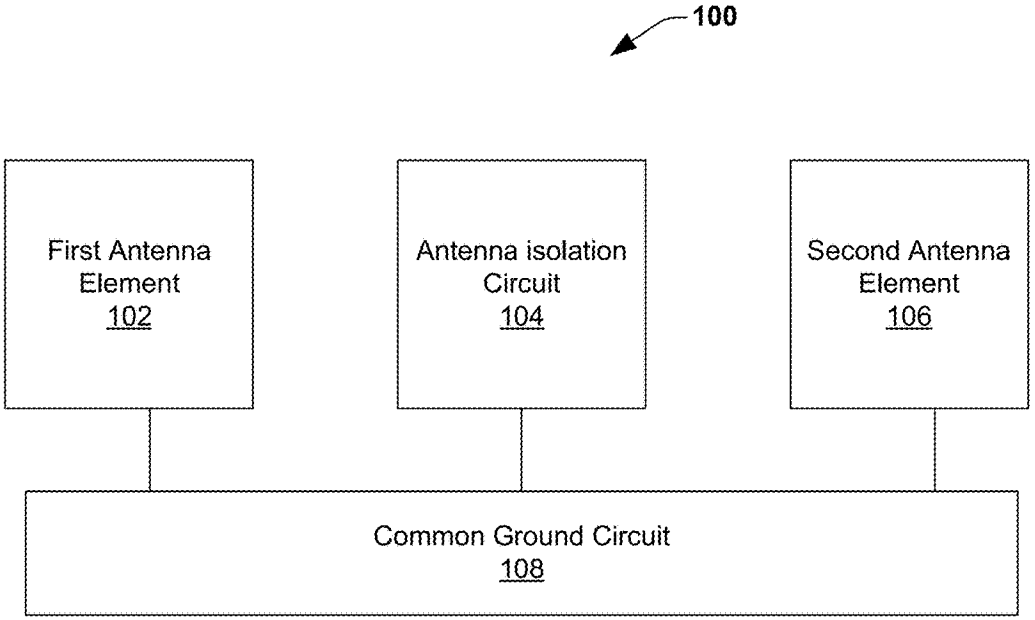
FIG. 1 depicts a simplified block diagram of an antenna system, according to one embodiment of the disclosure.

In one embodiment of the disclosure, an antenna isolation circuit configured to provide an isolation between two adjacent antennas in a wireless communication device is disclosed. The antenna isolation circuit comprises a partition line circuit comprising a conductive element configured to be placed between the two adjacent antennas and a matching circuit having a first end and a second end, wherein the matching circuit is coupled to the partition line circuit at the first end and to a ground circuit at the second end. In some embodiments, the matching circuit is configured to provide an impedance. In some embodiments, a dimension of the conductive element and the impedance of the matching circuit are configured to result in an isolation between the two adjacent antennas.

In one embodiment of the disclosure, an antenna system is disclosed. The antenna system comprises a first antenna element and a second, different, antenna element. The antenna system further comprises an antenna isolation circuit located between the first antenna element and the second antenna element, and configured to provide an isolation between the first antenna element and the second antenna element. In some embodiments, the antenna isolation circuit comprises a partition line circuit comprising a conductive element; and a matching circuit having a first end and a second end. In some embodiments, the matching circuit is coupled to the partition line circuit at the first end and to a ground circuit at the second end, and is configured to provide an impedance. In some embodiments, a dimension of the conductive element and the impedance of the matching circuit are configured to result in the isolation between the first antenna element and the second antenna element.

In one embodiment of the disclosure, a method for providing an isolation between two adjacent antennas in a wireless communication device is disclosed. The method comprises providing an antenna isolation circuit between the two adjacent antennas, the antenna isolation circuit comprising a partition line circuit comprising a conductive element; and a matching circuit having a first end and a second end, wherein the matching circuit is coupled to the partition line circuit at the first end and to a ground circuit at the second end. In some embodiments, the matching circuit is configured to provide an impedance. The method further comprises configuring a dimension of the conductive element and the impedance of the matching circuit to result in an isolation between the two adjacent antennas.

The present disclosure will now be described with reference to the attached drawing figures, wherein like reference numerals are used to refer to like elements throughout, and wherein the illustrated structures and devices are not necessarily drawn to scale. As utilized herein, terms "component," "system," "interface," "circuit" and the like are intended to refer to a computer-related entity, hardware, software (e.g., in execution), and/or firmware. For example, a component can be a processor (e.g., a microprocessor, a controller, or other processing device), a process running on a processor, a controller, an object, an executable, a program, a storage device, a computer, a tablet PC and/or a user equipment (e.g., mobile phone, etc.) with a processing device. By way of illustration, an application running on a server and the server can also be a component. One or more components can reside within a process, and a component can be localized on one computer and/or distributed between two or more computers. A set of elements or a set of other components can be described herein, in which the term "set" can be interpreted as "one or more."

Further, these components can execute from various computer readable storage media having various data structures stored thereon such as with a module, for example. The components can communicate via local and/or remote processes such as in accordance with a signal having one or more data packets (e.g., data from one component interacting with another component in a local system, distributed system, and/or across a network, such as, the Internet, a local area network, a wide area network, or similar network with other systems via the signal).

As another example, a component can be an apparatus with specific functionality provided by mechanical parts operated by electric or electronic circuitry, in which the electric or electronic circuitry can be operated by a software application or a firmware application executed by one or more processors. The one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components.

Use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form. Furthermore, to the event that the terms "including", "includes", "having", "has", "with", or variants thereof are used in either the detailed description and the claims, such terms are intended to be inclusive in a manner similar to the term "comprising."

The following detailed description refers to the accompanying drawings. The same reference numbers may be used in different drawings to identify the same or similar elements. In the following description, for purposes of explanation and not limitation, specific details are set forth such as particular structures, architectures, interfaces, techniques, etc. in order to provide a thorough understanding of the various aspects of various embodiments. However, it will be apparent to those skilled in the art having the benefit of the present disclosure that the various aspects of the various embodiments may be practiced in other examples that depart from these specific details. In certain instances, descriptions of well-known devices, circuits, and methods are omitted so as not to obscure the description of the various embodiments with unnecessary detail.

As indicated above, modern mobile devices are getting compact whereas numbers of the antennas are increasing to support advanced radio technologies like 5G technology. This makes it necessary to place the antennas closely or share the same volume. However, placing the antennas closely can result in crosstalk due to the coupling between the antennas, thereby resulting in performance degradation. Therefore, the antennas that share the same volume or are placed closely needs to be properly isolated from one another, in order to achieve the desired performance. Some of the techniques that are utilized currently to improve isolation between antennas include increasing the distance between the antennas, adding a choke between the antennas and adding a floated or grounded microstrip line between the antennas.

Further, in some of the current implementations, a ground slot, split ground, defected ground structure, meta materials etc. are utilized between the antennas, in order to improve the antenna isolation. However, the techniques utilized currently has certain limitations. For example, increasing the distance between the antennas requires more volume to get better isolation and therefore cannot fit in all the antennas in a mobile device. Further, the choke value utilized should be very precise, in order to achieve the decoupling of the antenna ports. Also, utilizing a choke can decouple only narrow and single frequency band. Similarly, floated and grounded microstrip line requires accurate length, in order to obtained balance. Therefore, the balance can be easily disturbed by human intervention and isolation between the antennas cannot be maintained. In addition, most of the decoupling techniques works well for single frequency and narrow band antennas and some methods require more space and complicated structure between the antennas.

In order to overcome the above disadvantages, a method to improve isolation between the antennas which share the same volume (placed closely) and work simultaneously is proposed in this disclosure. In particular, an antenna isolation circuit to be placed between the antennas that are placed closely is proposed herein, in order to improve the isolation between the antennas. In the embodiments described herein, the term "isolation" is used to at least refer to an electromagnetic isolation between the antennas or a conductive isolation between the antennas, or both. In some embodiments, the electromagnetic isolation can refer to avoiding an electromagnetic coupling between the antennas and the conductive isolation can refer to avoiding a current/voltage coupling between the antennas. In some embodiments, the proposed antenna isolation circuit comprises a partition line (e.g., a conductive element) that terminates in an impedance, further details of which are given in embodiments below. In some embodiments, the proposed antenna isolation circuit can provide isolation between antennas of same or different physical sizes, types or frequency bands. In some embodiments, utilizing the proposed antenna isolation circuit between the antennas enables to place more antennas in a smaller volume which will help to reduce the bezel size on the devices leading to a more appealing industrial design. This further enables to make available more area at the edges of the device to place microphone and other components. In some embodiments, utilizing the proposed antenna isolation circuit enables to fit 4×4 MIMO antennas that are utilized to support 5G technology into compact mobile devices without compromising its appealing industrial design (ID). In some embodiments, MIMO antennas comprises a plurality of antennas operating at the same frequency bands.

FIG. 1 depicts a simplified block diagram of an antenna system 100, according to one embodiment of the disclosure. In some embodiments, the antenna system 100 could be included within a wireless communication device, for example, a mobile phone, laptop computer, etc. The antenna system 100 comprises a first antenna element 102 and a second antenna element 106. However, in other embodiments, the antenna system 100 can comprise any number of antenna elements. In this embodiment, only two antenna elements, that is, the first antenna element 102 and the second antenna element 106 are shown, for the ease of reference. In some embodiments, the first antenna element 102 and the second antenna element 106 comprises adjacent antennas that are placed next to one another. The term "adjacent" herein indicates that the first antenna element 102 and the second antenna element 106 are neighboring antennas that are located closely to each other, and that there are no other antenna structures located between the first antenna element 102 and the second antenna element 106. In some embodiments, the first antenna element 102 and the second antenna element 106 are capable of simultaneous/concurrent transmission/reception of radio frequency (RF) signals.

The antenna system 100 further comprises an antenna isolation circuit 104 placed between the first antenna element 102 and the second antenna element 106, and configured to provide an isolation between the first antenna element 102 and the second antenna element 106. In some embodiments, the antenna isolation circuit 104 enables to provide isolation between closely spaced antenna elements in a wireless communication device. In this embodiment, the antenna system 100 is shown to comprise only one antenna isolation circuit 104, however, in other embodiments, the antenna system 100 can comprise an antenna isolation circuit between each pair of antenna elements, in order to provide isolation between the corresponding antenna pairs. The first antenna element 102 and the second antenna element 106 can be of same or different physical sizes, same or different types and can be configured to operate in same or different frequency bands. In some embodiments, the first antenna element 102 and the second antenna element 106 can comprise different types of antennas, for example, loop antennas, monopole antennas etc. In some embodiments, both the first antenna element 102 and the second antenna element 106 comprises the same type of antennas. However, in other embodiments, the first antenna element 102 can comprise a first type of antenna and the second antenna element 106 can comprise a second, different type of antenna. Further, the first antenna element 102 and the second antenna element 106 can be configured to operate over different wireless communication frequency bands.

For example, the first antenna element 102 and the second antenna element 106 can be configured to communicate over communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), long term evolution (LTE), 5G frequency bands, the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1550 MHz. The 850 MHz band is sometimes referred to as the Global System for Mobile (GSM) communications band. The 900 MHz communications band is sometimes referred to as the Extended GSM (EGSM) band. The 1800 MHz band is sometimes referred to as the Digital Cellular System (DCS) band. The 1900 MHz band is sometimes referred to as the Personal Communications Service (PCS) band. Further, other frequency bands, different from above, are also contemplated to be within the scope of this disclosure.

In some embodiments, both the first antenna element 102 and the second antenna element 106 may be configured to operate at the same frequency band (e.g., MIMO antennas). However, in other embodiments, the first antenna element 102 may be configured to operate at a first frequency band and the second antenna element 106 may be configured to operate at a second, different, frequency band. Further, in some embodiments, the first antenna element 102 or the second antenna element 106 or both can comprise dual band antennas, that is configured to operate at two frequency bands, for example, 2.4 GHz and 5 GHz. Further, in some embodiments, both the first antenna element 102 and the second antenna element 106 may be capable of simultaneous/concurrent transmission/reception of dually polarized signals. In some embodiments, the first antenna element 102, the second antenna element 106 and the antenna isolation circuit 104 are all coupled to a common ground circuit 108. In some embodiments, the common ground circuit 108 comprises ground wire associated with a printed circuit board (PCB). In some embodiments, the common ground circuit 108 can refer to a ground plane comprising a plurality of circuits or components, for example, one or more radio frequency (RF) transceiver circuitry, ground connections etc.

In some embodiments, the first antenna element 104 may be coupled to the common ground circuit 108 via a first radio frequency (RF) transceiver (not shown) associated with the first antenna element 102. In some embodiments, the first antenna element 104 comprises a first antenna port (not shown) that couples the first antenna element 102 to the first RF transceiver. Similarly, the second antenna element 106 may be coupled to the common ground circuit 108 via a second RF transceiver (not shown) associated with the second antenna element 106. In some embodiments, the second antenna element 106 comprises a second antenna port (not shown) that couples the second antenna element 106 to the second RF transceiver. In some embodiments, the first RF transceiver and the second RF transceiver may be the same.

In some embodiments, the antenna isolation circuit 104 is configured to couple to the electromagnetic radiations associated with the first antenna element 102 or the second antenna element 104 or both, and prevent electromagnetic coupling between the first antenna element 102 and the second antenna element 106, thereby enabling to provide isolation between the first antenna element 102 and the second antenna element 106. Further, in some embodiments, the antenna isolation circuit 104 reduces/avoids current coupling between the first antenna element 102 and the second antenna element 106 within the ground circuit 108 or the ground plane (or at their corresponding antenna ports), thereby enabling to provide/improve the isolation between the first antenna element 102 and the second antenna element 106. In some embodiments, the antenna isolation circuit 104 comprises a partition line circuit (not shown) and a matching circuit (not shown), the details of which are depicted in FIG. 2.

Figure 2:
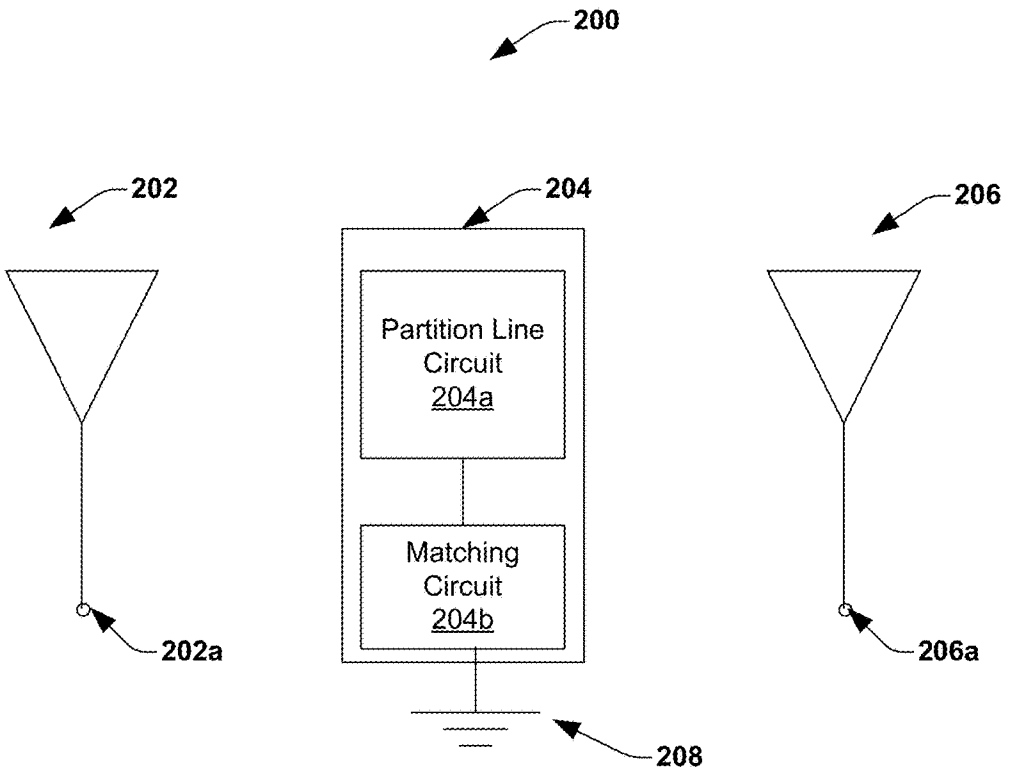
FIG. 2 depicts a detailed block diagram of an antenna system, according to one embodiment of the disclosure.

FIG. 2 depicts a detailed block diagram of an antenna system 200, according to one embodiment of the disclosure. In some embodiments, the antenna system 200 is a detailed depiction of the antenna system 100 in FIG. 1. The antenna system 200 comprises a first antenna element 202, a second antenna element 206 and an antenna isolation circuit 204 placed between the first antenna element 202 and the second antenna element 206. The first antenna element 202 and the second antenna element 206 are same as the first antenna element 102 and the second antenna element 106, respectively and can be explained in the same way and has the same characteristics as explained above with respect to FIG. 1. In some embodiments, the antenna isolation circuit 204 depicts a detailed depiction of the antenna isolation circuit 104 in FIG. 1. The antenna isolation circuit 204 comprises a partition line circuit 204*a* and a matching circuit 204*b*.

In some embodiments, the first antenna element 202, the second antenna element 206 and the antenna isolation circuit 204 are coupled to a ground circuit 208. In some embodiments, the ground circuit 208 is same as the ground circuit 108 in FIG. 1. In some embodiments, the first antenna element 202 is coupled to the ground circuit 208 via a first antenna port 202*a* and the second antenna element 202 is coupled to the ground circuit 208 via a second antenna port 206*a*. In some embodiments, the partition line circuit 204*a* comprises a conductive element (not shown) configured to be placed between the first antenna element 202 and the second antenna element 206. In some embodiments, a position and/or a dimension of the conductive element is configured in a way to enable electromagnetic coupling between the conductive element (i.e., the partition line circuit 204*a*) and the two antennas, that is, the first antenna element 202 and the second antenna element 206. In some embodiments, a dimension of the conductive element comprises one or more of a length, width, height, cross-sectional area, shape and orientation of the conductive element. However, in other embodiments, other features different from above can also characterize the dimension, for example, aspect ratio. In some embodiments, the conductive element can take different forms or shapes, for example, a metal strip, a loop structure etc. In some embodiments, the position or the dimension of the conductive element is configured, in order to achieve an optimum electromagnetic coupling between the conductive element (i.e., the partition line circuit 204*a*) and the two antennas, that is, the first antenna element 202 and the second antenna element 206.

In some embodiments, the conductive element is configured to couple to the first antenna element 202 or the second antenna element 206 or both, upon excitation of the corresponding antennas. For example, in some embodiments, when the first antenna element 202 is excited, the conductive element couples to the electromagnetic radiation associated with the first antenna element 202. Similarly, in some embodiments, when the second antenna element 206 is excited, the conductive element couples to the electromagnetic radiation associated with the second antenna element 206. Further, in some embodiments, both the first antenna element 202 and the second antenna element 206 may be excited simultaneously, and in such embodiments, the conductive element couples to the electromagnetic radiation associated with both the first antenna element 202 and the second antenna element 206 at the same time or simultaneously. In some embodiments, the electromagnetic coupling of the partition line circuit 204*a* to the first antenna element 202 or the second antenna element 206 or both, enables to prevent or reduce the electromagnetic coupling between the first antenna element 202 and the second antenna element 206 (i.e., the adjacent antennas).

Upon coupling with the first antenna element 202 or the second antenna element 206 or both, in some embodiments, the partition line circuit 204*a* is configured to generate a coupled current associated with a respective antenna, within the partition line circuit 204*a*. In some embodiments, the coupled current within the partition line circuit 204*a* has the same or similar characteristics (polarity, phase, amplitude etc.) as the current flowing through a respective antenna element. For example, upon coupling with the first antenna element 202, the partition line circuit 204*a* is configured to generate a first coupled current. In some embodiments, the first coupled current has the same characteristics (polarity, phase, amplitude etc.) as the current flowing through the first antenna element 202. Similarly, upon coupling with the second antenna element 206, the partition line circuit 204*a* is configured to generate a second coupled current. In some embodiments, the second coupled current has the same characteristics (polarity, phase, amplitude etc.) as the current flowing through the second antenna element 206.

The matching circuit 204*b* is coupled to the partition line circuit 204*a* and is configured to provide an impedance. In some embodiments, the matching circuit 204*b* enables to terminate the partition line circuit 204*a* with an impedance. In some embodiments, the matching circuit 204*b* comprises a first end and a second end, wherein the matching circuit 204*b* is coupled to the partition line circuit 204*a* at the first end and wherein the matching circuit 204*b* is coupled to the ground circuit 208 at the second end. In some embodiments, the matching circuit 204*a* is configured to receive the coupled current associated with the first antenna element 202 or the second antenna element 206 or both, and reverse a polarity of the received coupled current, based on the impedance, prior to providing the coupled current to the ground circuit 208. For example, in one embodiment, if the first antenna element 202 is excited, the partition line circuit 204*a* is configured to generate the first coupled current associated with the first antenna element 202 within the partition line circuit 204 and the matching circuit 204*b* is configured to reverse the polarity of the first coupled current, prior to providing the first coupled current to the ground circuit 208. Therefore, in such embodiments, current flow in the ground circuit 208 due to the first antenna element 202 and the antenna isolation circuit 204 are opposite in polarity, thereby resulting in a cancellation of the current due to the first antenna element 202 within the ground circuit 208. In some embodiments, the cancellation of the current due to the first antenna element 202 within the ground circuit 208 enables to prevent a current coupling between the first antenna element 202 and the second antenna element 206 (or their respective antenna ports).

Similarly, in some embodiments, if the second antenna element 204 is excited, the partition line circuit 204*a* is configured to generate the second coupled current associated with the second antenna element 206 within the partition line circuit 204 and the matching circuit 204*b* is configured to reverse the polarity of the second coupled current, prior to providing the second coupled current to the ground circuit 208. Therefore, in such embodiments, current flow in the ground circuit 208 due to the second antenna element 206 and the antenna isolation circuit 204 are opposite in polarity, thereby resulting in a cancellation of the current due to the second antenna element 206 within the ground circuit 208. In some embodiments, the cancellation of the current due to the second antenna element 206 within the ground circuit 208 enables to prevent a current coupling between the second antenna element 206 and the first antenna element 202 (or their respective antenna ports). In some embodiments, both the first antenna element 202 and the second antenna element 206 may be excited simultaneously. In such embodiments, the partition line circuit 204*a* can generate both the first coupled current associated with the first antenna element 202 and the second coupled current associated with the second antenna element 206, simultaneously or at the same time. Further, the matching circuit 204 can reverse the polarity of both the first coupled current and the second coupled current, thereby resulting in a cancellation of the current due to both the first antenna element 202 and the second antenna element 206 within the ground circuit 208. Therefore, in some embodiments, the matching circuit 204 enables to decouple the antenna ports associated with the first antenna element 202 and the second antenna element 206.

In some embodiments, the impedance associated with the matching circuit 204*b* is chosen/configured so as to enable the matching circuit 204*b* to reverse the polarity of the coupled current associated therewith. In some embodiments, the impedance provided by the matching circuit 204*b* comprises a complex impedance comprising a real part and an imaginary part. In some embodiments, the matching circuit

204*b* comprises a resistive element that contributes a real part of the impedance and a reactive element that contributes an imaginary part of the impedance. In some embodiments, the resistive element comprises one or more resistors (e.g., 150 Ohm resistor) and the reactive element comprises one or more inductors (e.g., a 3.3 nH inductor). However, in other embodiments, the reactive part can comprise one or more capacitors or a combination of inductors and capacitors. In some embodiments, the resistive element and the reactive element associated with the matching circuit 204*a* are coupled in parallel to one another. However, the resistive elements and the reactive elements can be connected differently, in other embodiments. Further, in other embodiments, the matching circuit 204*b* can be implemented differently, depending upon the isolation requirements. For example, in some embodiments, the impedance provided by the matching circuit 204*b* can be purely resistive. Therefore, in such embodiments, the matching circuit 204*b* comprises one or more resistors. Further, in some embodiments, the impedance provided by the matching circuit 204*b* can be purely reactive. Therefore, in such embodiments, the matching circuit 204*b* can comprise one or more inductors, or one or more capacitors, or a combination of inductors and capacitors.

Figure 3:
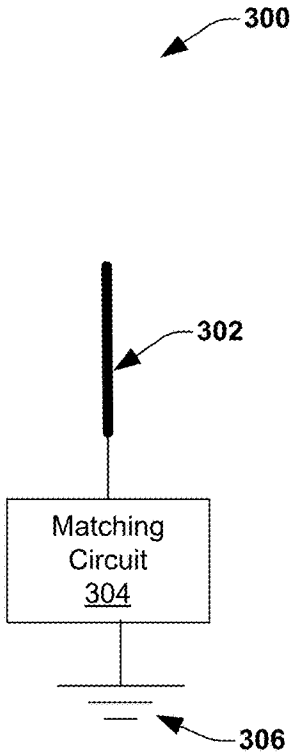
FIG. 3 depicts an example implementation of an antenna isolation circuit, according to one embodiment of the disclosure.

FIG. 3 depicts an example implementation of an antenna isolation circuit 300, according to one embodiment of the disclosure. In some embodiments, the antenna isolation circuit 300 depicts one possible way of implementation of the antenna isolation circuit 104 in FIG. 1 or the antenna isolation circuit 204 in FIG. 2. In some embodiments, the antenna isolation circuit 300 can be included within the antenna isolation circuit 204 in FIG. 2, and is therefore explained herein with reference to the antenna system 200 in FIG. 2. The antenna isolation circuit comprises a partition line circuit 302 and a matching circuit 304. The partition line circuit 304 comprises a metal strip as a conductive element. In some embodiments, a metal strip comprises a rectangular metal element having a length and a width associated therewith. However, in other embodiments, other implementations of a conducive element, for example, a metal sheet, a metal loop etc. can also be utilized. In some embodiments, the partition line circuit 302 (or the conductive element associated therewith) can be implemented as a conducive trace on a printed circuit board (PCB). In other embodiments, the partition line circuit 302 can comprise a conductive element that is embedded to the surface of the PCB (not as a trace). Further, in some embodiments, the partition line circuit 302 can comprise a conductive element that is, at least in part, detached from the PCB (e.g., in the air).

In some embodiments, the partition line circuit 302 is configured to couple to electromagnetic radiation associated with one or more antennas (e.g., the first antenna element 202 or the second antenna element 206 or both in FIG. 2), upon excitation of the corresponding antennas and generate a coupled current associated with the respective antennas, as explained above with respect to FIG. 2. The matching circuit 304 is coupled to the partition line circuit 302 and is configured to receive the coupled current generated within the partition line circuit 302. In some embodiments, the matching circuit 304 is configured to provide an impedance. In some embodiments, the matching circuit 304 is further configured to reverse a polarity of the coupled current received from the partition line circuit 302, based on the impedance associated therewith and provide the coupled current with reversed polarity to a ground circuit 306, as explained above with respect to FIG. 2. In some embodiments, the matching circuit 304 is further coupled to the ground circuit 306. In some embodiments, the ground circuit 306 comprises a PCB ground (associated with a PCB ground plane).

In some embodiments, the impedance provided by the matching circuit 204*b* comprises a complex impedance comprising a real part and an imaginary part. In some embodiments, the matching circuit 304 comprises a resistive element that contributes a real part of the impedance and a reactive element that contributes an imaginary part of the impedance. Therefore, in some embodiments, the matching circuit 304 comprises one or more resistors (that contributes the resistive element of the impedance) and one or more inductors (that contributes the reactive element of the impedance). However, in other embodiments, the reactance part of the matching circuit 304 may be implemented differently, for example, by one or more capacitors or by a combination of inductors and capacitors. In some embodiments, the resistor (i.e., the resistive element) and the inductor (i.e., the reactive element) are connected in parallel. However, the resistive elements and the reactive elements can be connected differently, in other embodiments Further, depending on the isolation requirements, other implementations of the matching circuit 304 are also contemplated to be within the scope of this disclosure. For example, in some embodiments, the impedance provided by the matching circuit 304 can be purely resistive. Therefore, in such embodiments, the matching circuit 304 comprises one or more resistors. Further, in some embodiments, the impedance provided by the matching circuit 304 can be purely reactive. Therefore, in such embodiments, the matching circuit 304 can comprise one or more inductors, or one or more capacitors, or a combination of inductors and capacitors.

Figure 4:
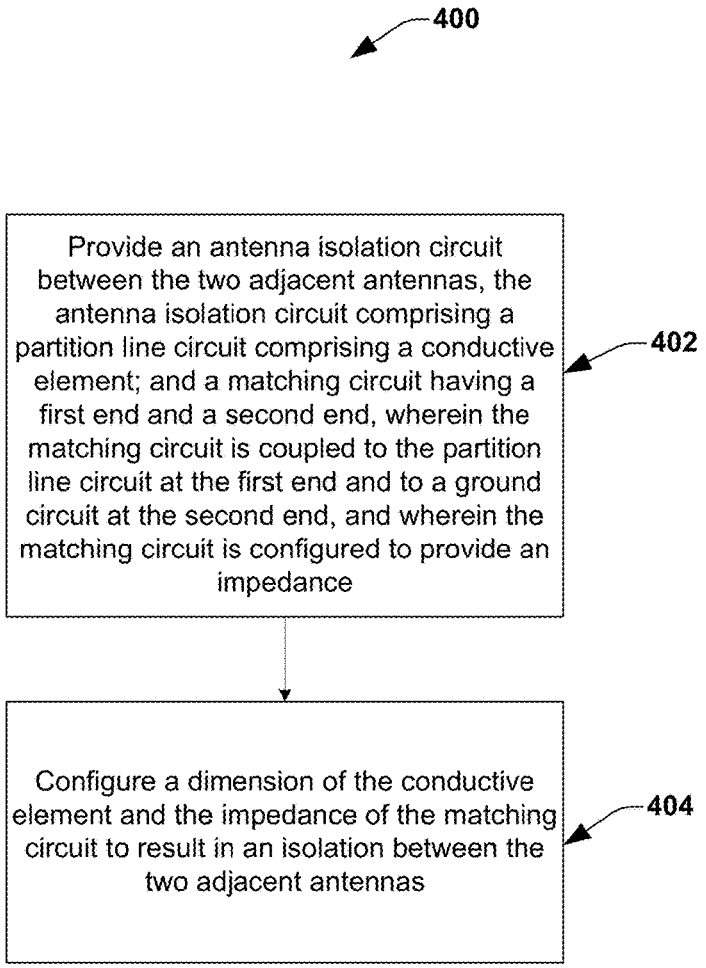
FIG. 4 illustrates a flow chart of a method for providing isolation between two adjacent antennas in a wireless communication device, according to one embodiment of the disclosure.

FIG. 4 illustrates a flow chart of a method 400 for providing isolation between two adjacent antennas in a wireless communication device, according to one embodiment of the disclosure. The method 400 is explained herein with reference to antenna isolation circuit 204 in FIG. 2 and the antenna isolation circuit 300 in FIG. 3. At 402, an antenna isolation circuit (e.g., the antenna isolation circuit 204 in FIG. 2) is provided between the two adjacent antennas (e.g., the first antenna element 202 and the second antenna element 206 in FIG. 2). In some embodiments, the antenna isolation circuit comprises a partition line circuit (e.g., the partition line circuit 204*a* in FIG. 2 or the partition line circuit 302 in FIG. 3) comprising a conductive element; and a matching circuit (e.g., the matching circuit 204*b* in FIG. 2 or the matching circuit 304 in FIG. 3) having a first end and a second end, wherein the matching circuit is coupled to the partition line circuit at the first end and to a ground circuit (e.g., the ground circuit 208 in FIG. 2) at the second end.

In some embodiments, the matching circuit is configured to provide an impedance. In some embodiments, the impedance provided by the matching circuit comprises a complex impedance comprising a real part and an imaginary part. In some embodiments, the matching circuit comprises a resistive element that contributes the real part of the impedance and a reactive element that contributes the imaginary part of the impedance. Therefore, in some embodiments, the matching circuit comprises one or more resistors (that contributes the resistive element of the impedance) and one or more inductors (that contributes the reactive element of the impedance). However, in other embodiments, the reactance part of the matching circuit may be implemented differently, for example, by one or more capacitors or by a combination of inductors and capacitors. In some embodiments, the resistor (i.e., the resistive element) and the inductor (i.e., the reactive element) are connected in parallel. However, the resistive elements and the reactive elements can be connected differently, in other embodiments. Further, depending on the isolation requirements, other implementations of the matching circuit are also contemplated to be within the scope of this disclosure. For example, in some embodiments, the impedance provided by the matching circuit can be purely resistive. Therefore, in such embodiments, the matching circuit comprises one or more resistors. Further, in some embodiments, the impedance provided by the matching circuit can be purely reactive. Therefore, in such embodiments, the matching circuit can comprise one or more inductors, or one or more capacitors, or a combination of inductors and capacitors.

At 404, a dimension of the conductive element associated with the partition line circuit and the impedance of the matching circuit are configured to result in an isolation between the two adjacent antennas. In some embodiments, the dimension of the conductive element comprises one or more of a length, width, height, cross-sectional area, shape and orientation of the conductive element. In some embodiments, the partition line circuit is configured to electromagnetically couple to one or more antennas of the two adjacent antennas, upon excitation of the corresponding antennas, based on the dimension of the conductive element, thereby reducing electromagnetic coupling between the two antennas. In some embodiments, the partition line circuit is further configured to generate a coupled current associated with the one or more antennas within the partition line circuit, based on the electromagnetic coupling. Further, in some embodiments, the matching circuit is configured to receive the coupled current from the partition line circuit and reverse a polarity of the coupled current associated with the one or more antennas, by utilizing the impedance associated with the matching circuit. In some embodiments, the matching circuit is further configured to provide the coupled current with the reversed polarity to the ground circuit, in order to cancel the current due to the one or more antennas in the ground circuit, thereby reducing the current coupling between the two adjacent antennas (or their respective antenna ports).

While the methods are illustrated, and described above as a series of acts or events, it will be appreciated that the illustrated ordering of such acts or events are not to be interpreted in a limiting sense. For example, some acts may occur in different orders and/or concurrently with other acts or events apart from those illustrated and/or described herein. In addition, not all illustrated acts may be required to implement one or more aspects or embodiments of the disclosure herein. Also, one or more of the acts depicted herein may be carried out in one or more separate acts and/or phases.

Figure 5A:
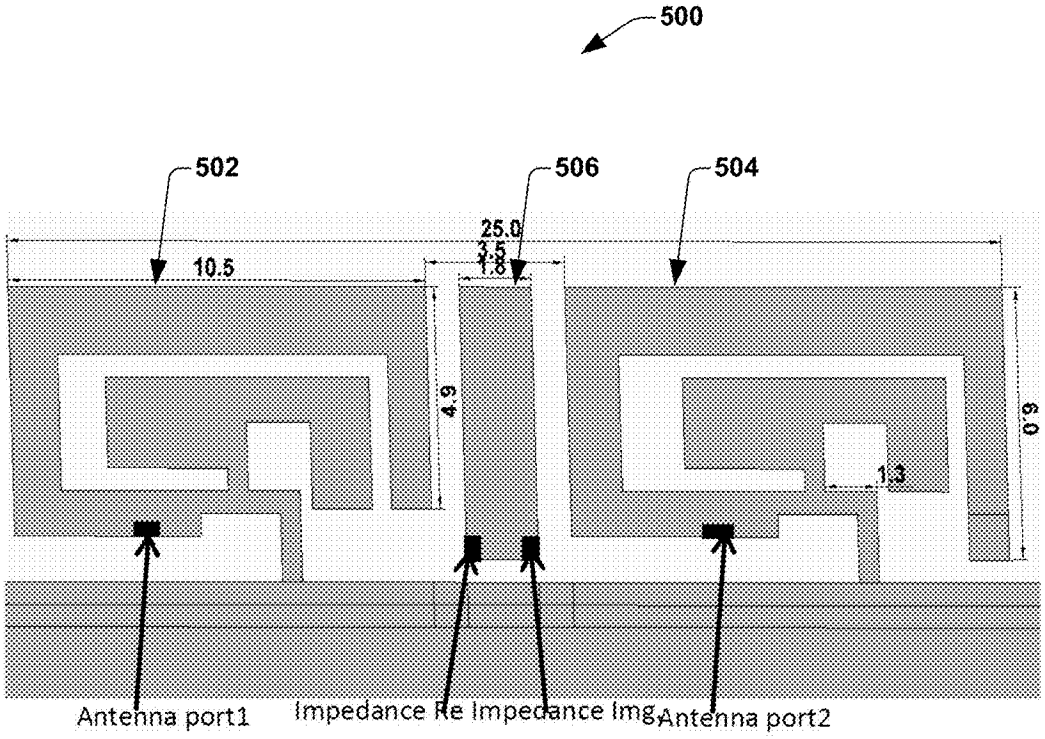
FIG. 5*a* illustrates an example implementation of an antenna system, according to one embodiment of the disclosure.

FIG. 5*a* illustrates an example implementation of an antenna system 500, according to one embodiment of the disclosure. The antenna system 500 comprises two dual band WLAN antennas 502 and 504 designed in 25 mm×6.5 mm PCB area. In this example embodiment, the antennas 502 and 504 are designed to be embedded on the surface of a PCB. However, in other embodiments, the antennas 502 or 504 or both may be implemented differently, for example, having at least a part of the antenna structure being suspended in the air. FIG. 5*a* illustrates one possible way of implementation (or a prototype) of the antenna system 100 in FIG. 1 or the antenna system 200 in FIG. 2 and is not to be construed as limiting. The antennas 502 and 504 are designed to resonate at 2.4 GHz and 5 GHz WLAN bands. The antennas 502 and 504 are designed to be 3.5 mm apart from one another (i.e., they are placed very close to one another). The antenna system 500 further comprises an antenna isolation circuit 506 of 6 mm×1.8 mm inserted between the two antennas without increasing the area of the antenna system 500. The antenna isolation circuit 506 comprises a partition line circuit (the metal strip) that terminates in an impedance. Here the impedance is contributed by a 150 Ohm resistor and a 3.3 nH inductor.

Figure 5B:
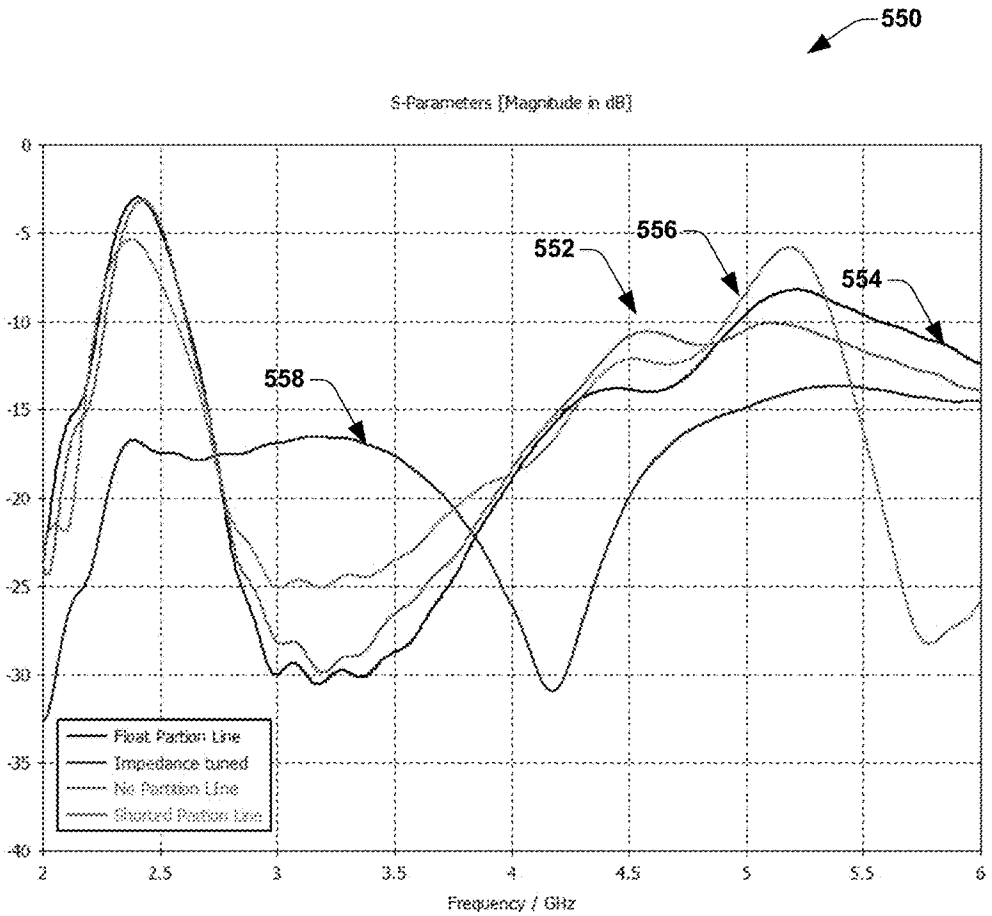
FIG. 5*b* illustrates a graph showing S-parameters indicative of an isolation between two adjacent antennas (closely placed), according to one embodiment of the disclosure.

FIG. 5*b* illustrates a graph 550 showing S-parameters indicative of an isolation between two adjacent antennas (closely placed), according to one embodiment of the disclosure. In some embodiments, the two adjacent antennas considered herein corresponds to the antennas 502 and 504 in FIG. 5*a*. In some embodiments, the graph 550 shows the S-parameters associated with the two antennas 502 and 504 for different configurations of the antennas 502 and 504, for example, without inserting any antenna isolation circuitry (e.g., the antenna isolation circuit 506) between the antennas (trace 552), inserting a floated partition line circuit (without impedance) between the antennas (trace 554), inserting a shorted partition line circuit (without impedance) between the antennas (trace 556) and inserting a partition line circuit with impedance (i.e., the antenna isolation circuit 506) between the antennas (trace 558). The trace 558 shows that there is approximately 17 dB isolation between the antennas 502 and 504 at 2.4 GHz, with the partition line circuit with impedance (i.e., the antenna isolation circuit 506) inserted between the antennas. Further, the trace 552 shows that there is approximately 3 dB isolation between the antennas 502 and 504 at 2.4 GHz, without the antenna isolation circuit 506 inserted between the antennas. This shows that the antenna isolation circuit 506 helps to achieve good isolation between the antennas 502 and 504.

Figure 6:
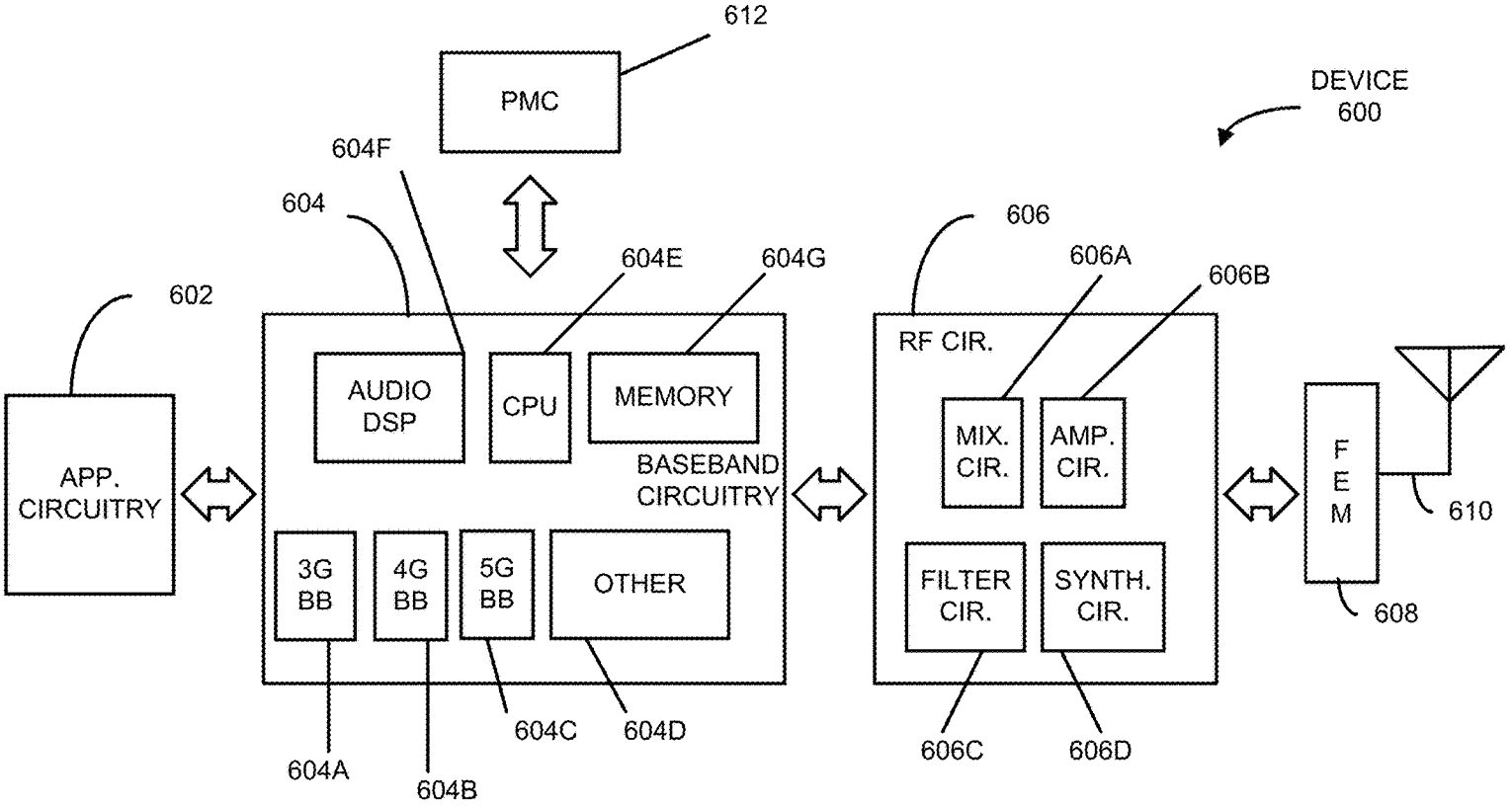
FIG. 6 illustrates example components of a device in accordance with some embodiments.

FIG. 6 illustrates example components of a device 600 in accordance with some embodiments. In some embodiments, the device 600 may include application circuitry 602, baseband circuitry 604, Radio Frequency (RF) circuitry 606, front-end module (FEM) circuitry 608, one or more antennas 610, and power management circuitry (PMC) 612 coupled together at least as shown. The components of the illustrated device 600 may be included in a UE or a RAN node. In some embodiments, the antenna system 100 in FIG. 1 and the antenna system 200 in FIG. 2 could be implemented as a part of the device 600. In some embodiments, the device 600 may include less elements (e.g., a RAN node may not utilize application circuitry 602, and instead include a processor/controller to process IP data received from an EPC). In some embodiments, the device 600 may include additional elements such as, for example, memory/storage, display, camera, sensor, or input/output (I/O) interface. In other embodiments, the components described below may be included in more than one device (e.g., said circuitries may be separately included in more than one device for Cloud-RAN (C-RAN) implementations).

The application circuitry 602 may include one or more application processors. For example, the application circuitry 602 may include circuitry such as, but not limited to, one or more single-core or multi-core processors. The processor(s) may include any combination of general-purpose processors and dedicated processors (e.g., graphics processors, application processors, etc.). The processors may be coupled with or may include memory/storage and may be configured to execute instructions stored in the memory/storage to enable various applications or operating systems to run on the device 600. In some embodiments, processors of application circuitry 602 may process IP data packets received from an EPC.

The baseband circuitry 604 may include circuitry such as, but not limited to, one or more single-core or multi-core processors. The baseband circuitry 604 may include one or more baseband processors or control logic to process baseband signals received from a receive signal path of the RF circuitry 606 and to generate baseband signals for a transmit signal path of the RF circuitry 606. Baseband processing circuitry 604 may interface with the application circuitry 602 for generation and processing of the baseband signals and for controlling operations of the RF circuitry 606. For example, in some embodiments, the baseband circuitry 604 may include a third generation (3G) baseband processor 604A, a fourth generation (4G) baseband processor 604B, a fifth generation (5G) baseband processor 604C, or other baseband processor(s) 604D for other existing generations, generations in development or to be developed in the future (e.g., second generation (2G), sixth generation (6G), etc.). The baseband circuitry 604 (e.g., one or more of baseband processors 604A-D) may handle various radio control functions that enable communication with one or more radio networks via the RF circuitry 606. In other embodiments, some or all of the functionality of baseband processors 604A-D may be included in modules stored in the memory 604G and executed via a Central Processing Unit (CPU) 604E. The radio control functions may include, but are not limited to, signal modulation/demodulation, encoding/decoding, radio frequency shifting, etc. In some embodiments, modulation/demodulation circuitry of the baseband circuitry 604 may include Fast-Fourier Transform (FFT), precoding, or constellation mapping/demapping functionality. In some embodiments, encoding/decoding circuitry of the baseband circuitry 604 may include convolution, tail-biting convolution, turbo, Viterbi, or Low Density Parity Check (LDPC) encoder/decoder functionality. Embodiments of modulation/demodulation and encoder/decoder functionality are not limited to these examples and may include other suitable functionality in other embodiments.

In some embodiments, the baseband circuitry 604 may include one or more audio digital signal processor(s) (DSP) 604F. The audio DSP(s) 604F may be include elements for compression/decompression and echo cancellation and may include other suitable processing elements in other embodiments. Components of the baseband circuitry may be suitably combined in a single chip, a single chipset, or disposed on a same circuit board in some embodiments. In some embodiments, some or all of the constituent components of the baseband circuitry 604 and the application circuitry 602 may be implemented together such as, for example, on a system on a chip (SOC).

In some embodiments, the baseband circuitry 604 may provide for communication compatible with one or more radio technologies. For example, in some embodiments, the baseband circuitry 604 may support communication with an evolved universal terrestrial radio access network (EUTRAN) or other wireless metropolitan area networks (WMAN), a wireless local area network (WLAN), a wireless personal area network (WPAN). Embodiments in which the baseband circuitry 604 is configured to support radio communications of more than one wireless protocol may be referred to as multi-mode baseband circuitry.

RF circuitry 606 may enable communication with wireless networks using modulated electromagnetic radiation through a non-solid medium. In various embodiments, the RF circuitry 606 may include switches, filters, amplifiers, etc. to facilitate the communication with the wireless network. RF circuitry 606 may include a receive signal path which may include circuitry to down-convert RF signals received from the FEM circuitry 608 and provide baseband signals to the baseband circuitry 604. RF circuitry 606 may also include a transmit signal path which may include circuitry to up-convert baseband signals provided by the baseband circuitry 604 and provide RF output signals to the FEM circuitry 608 for transmission.

In some embodiments, the receive signal path of the RF circuitry 606 may include mixer circuitry 606*a*, amplifier circuitry 606*b* and filter circuitry 606*c*. In some embodiments, the transmit signal path of the RF circuitry 606 may include filter circuitry 606*c* and mixer circuitry 606*a*. RF circuitry 606 may also include synthesizer circuitry 606*d* for synthesizing a frequency for use by the mixer circuitry 606*a* of the receive signal path and the transmit signal path. In some embodiments, the mixer circuitry 606*a* of the receive signal path may be configured to down-convert RF signals received from the FEM circuitry 608 based on the synthesized frequency provided by synthesizer circuitry 606*d*. The amplifier circuitry 606*b* may be configured to amplify the down-converted signals and the filter circuitry 606*c* may be a low-pass filter (LPF) or band-pass filter (BPF) configured to remove unwanted signals from the down-converted signals to generate output baseband signals. Output baseband signals may be provided to the baseband circuitry 604 for further processing. In some embodiments, the output baseband signals may be zero-frequency baseband signals, although this is not a requirement. In some embodiments, mixer circuitry 606*a* of the receive signal path may comprise passive mixers, although the scope of the embodiments is not limited in this respect.

In some embodiments, the mixer circuitry 606*a* of the transmit signal path may be configured to up-convert input baseband signals based on the synthesized frequency provided by the synthesizer circuitry 606*d* to generate RF output signals for the FEM circuitry 608. The baseband signals may be provided by the baseband circuitry 604 and may be filtered by filter circuitry 606*c*.

In some embodiments, the mixer circuitry 606*a* of the receive signal path and the mixer circuitry 606*a* of the transmit signal path may include two or more mixers and may be arranged for quadrature downconversion and upconversion, respectively. In some embodiments, the mixer circuitry 606*a* of the receive signal path and the mixer circuitry 606*a* of the transmit signal path may include two or more mixers and may be arranged for image rejection (e.g., Hartley image rejection). In some embodiments, the mixer circuitry 606*a* of the receive signal path and the mixer circuitry 606*a* may be arranged for direct downconversion and direct upconversion, respectively. In some embodiments, the mixer circuitry 606*a* of the receive signal path and the mixer circuitry 606*a* of the transmit signal path may be configured for super-heterodyne operation.

In some embodiments, the output baseband signals and the input baseband signals may be analog baseband signals, although the scope of the embodiments is not limited in this respect. In some alternate embodiments, the output baseband signals and the input baseband signals may be digital baseband signals. In these alternate embodiments, the RF circuitry 606 may include analog-to-digital converter (ADC) and digital-to-analog converter (DAC) circuitry and the baseband circuitry 604 may include a digital baseband interface to communicate with the RF circuitry 606.

In some dual-mode embodiments, a separate radio IC circuitry may be provided for processing signals for each spectrum, although the scope of the embodiments is not limited in this respect.

In some embodiments, the synthesizer circuitry 606*d* may be a fractional-N synthesizer or a fractional N/N+1 synthesizer, although the scope of the embodiments is not limited in this respect as other types of frequency synthesizers may be suitable. For example, synthesizer circuitry 606*d* may be a delta-sigma synthesizer, a frequency multiplier, or a synthesizer comprising a phase-locked loop with a frequency divider.

The synthesizer circuitry 606*d* may be configured to synthesize an output frequency for use by the mixer circuitry 606*a* of the RF circuitry 606 based on a frequency input and a divider control input. In some embodiments, the synthesizer circuitry 606*d* may be a fractional N/N+1 synthesizer.

In some embodiments, frequency input may be provided by a voltage controlled oscillator (VCO), although that is not a requirement. Divider control input may be provided by either the baseband circuitry 604 or the applications processor 602 depending on the desired output frequency. In some embodiments, a divider control input (e.g., N) may be determined from a look-up table based on a channel indicated by the applications processor 602.

Synthesizer circuitry 606*d* of the RF circuitry 606 may include a divider, a delay-locked loop (DLL), a multiplexer and a phase accumulator. In some embodiments, the divider may be a dual modulus divider (DMD) and the phase accumulator may be a digital phase accumulator (DPA). In some embodiments, the DMD may be configured to divide the input signal by either N or N+1 (e.g., based on a carry out) to provide a fractional division ratio. In some example embodiments, the DLL may include a set of cascaded, tunable, delay elements, a phase detector, a charge pump and a D-type flip-flop. In these embodiments, the delay elements may be configured to break a VCO period up into Nd equal packets of phase, where Nd is the number of delay elements in the delay line. In this way, the DLL provides negative feedback to help ensure that the total delay through the delay line is one VCO cycle.

In some embodiments, synthesizer circuitry 606*d* may be configured to generate a carrier frequency as the output frequency, while in other embodiments, the output frequency may be a multiple of the carrier frequency (e.g., twice the carrier frequency, four times the carrier frequency) and used in conjunction with quadrature generator and divider circuitry to generate multiple signals at the carrier frequency with multiple different phases with respect to each other. In some embodiments, the output frequency may be a LO frequency (fLO). In some embodiments, the RF circuitry 606 may include an IQ/polar converter.

FEM circuitry 608 may include a receive signal path which may include circuitry configured to operate on RF signals received from one or more antennas 610, amplify the received signals and provide the amplified versions of the received signals to the RF circuitry 606 for further processing. FEM circuitry 608 may also include a transmit signal path which may include circuitry configured to amplify signals for transmission provided by the RF circuitry 606 for transmission by one or more of the one or more antennas 610. In various embodiments, the amplification through the transmit or receive signal paths may be done solely in the RF circuitry 606, solely in the FEM 608, or in both the RF circuitry 606 and the FEM 608.

In some embodiments, the FEM circuitry 608 may include a TX/RX switch to switch between transmit mode and receive mode operation. The FEM circuitry may include a receive signal path and a transmit signal path. The receive signal path of the FEM circuitry may include an LNA to amplify received RF signals and provide the amplified received RF signals as an output (e.g., to the RF circuitry 606). The transmit signal path of the FEM circuitry 608 may include a power amplifier (PA) to amplify input RF signals (e.g., provided by RF circuitry 606), and one or more filters to generate RF signals for subsequent transmission (e.g., by one or more of the one or more antennas 610).

In some embodiments, the PMC 612 may manage power provided to the baseband circuitry 604. In particular, the PMC 612 may control power-source selection, voltage scaling, battery charging, or DC-to-DC conversion. The PMC 612 may often be included when the device 600 is capable of being powered by a battery, for example, when the device is included in a UE. The PMC 612 may increase the power conversion efficiency while providing desirable implementation size and heat dissipation characteristics.

While FIG. 6 shows the PMC 612 coupled only with the baseband circuitry 604. However, in other embodiments, the PMC 8 12 may be additionally or alternatively coupled with, and perform similar power management operations for, other components such as, but not limited to, application circuitry 602, RF circuitry 606, or FEM 608.

In some embodiments, the PMC 612 may control, or otherwise be part of, various power saving mechanisms of the device 600. For example, if the device 600 is in an RRC_Connected state, where it is still connected to the RAN node as it expects to receive traffic shortly, then it may enter a state known as Discontinuous Reception Mode (DRX) after a period of inactivity. During this state, the device 600 may power down for brief intervals of time and thus save power.

If there is no data traffic activity for an extended period of time, then the device 600 may transition off to an RRC_Idle state, where it disconnects from the network and does not perform operations such as channel quality feedback, handover, etc. The device 600 goes into a very low power state and it performs paging where again it periodically wakes up to listen to the network and then powers down again. The device 600 may not receive data in this state, in order to receive data, it must transition back to RRC_Connected state.

An additional power saving mode may allow a device to be unavailable to the network for periods longer than a paging interval (ranging from seconds to a few hours). During this time, the device is totally unreachable to the network and may power down completely. Any data sent during this time incurs a large delay and it is assumed the delay is acceptable.

Processors of the application circuitry 602 and processors of the baseband circuitry 604 may be used to execute elements of one or more instances of a protocol stack. For example, processors of the baseband circuitry 604, alone or in combination, may be used execute Layer 3, Layer 2, or Layer 1 functionality, while processors of the application circuitry 604 may utilize data (e.g., packet data) received from these layers and further execute Layer 4 functionality (e.g., transmission communication protocol (TCP) and user datagram protocol (UDP) layers). As referred to herein, Layer 3 may comprise a radio resource control (RRC) layer, described in further detail below. As referred to herein, Layer 2 may comprise a medium access control (MAC) layer, a radio link control (RLC) layer, and a packet data convergence protocol (PDCP) layer, described in further detail below. As referred to herein, Layer 1 may comprise a physical (PHY) layer of a UE/RAN node, described in further detail below.

While the apparatus has been illustrated and described with respect to one or more implementations, alterations and/or modifications may be made to the illustrated examples without departing from the spirit and scope of the appended claims. In particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention.

In particular regard to the various functions performed by the above described components (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the disclosure. In addition, while a particular feature may have been disclosed with respect to only one of several implementations, such feature may be combined with one or more other features of the other implementations as may be desired and advantageous for any given or particular application.

Examples can include subject matter such as a method, means for performing acts or blocks of the method, at least one machine-readable medium including instructions that, when performed by a machine cause the machine to perform acts of the method or of an apparatus or system for concurrent communication using multiple communication technologies according to embodiments and examples described herein.

Example 1 is an antenna isolation circuit configured to provide an isolation between two adjacent antennas in a wireless communication device. The antenna isolation circuit comprises a partition line circuit comprising a conductive element configured to be placed between the two adjacent antennas; and a matching circuit having a first end and a second end, wherein the matching circuit is coupled to the partition line circuit at the first end and to a ground circuit at the second end, and wherein the matching circuit is configured to provide an impedance; wherein a dimension of the conductive element and the impedance of the matching circuit are configured to result in an isolation between the two adjacent antennas.

Example 2 is a circuit, including the subject matter of example 1, wherein the dimension of the conductive element comprises one or more of a length, width, height, cross-sectional area, shape and orientation of the conductive element.

Example 3 is a circuit, including the subject matter of examples 1-2, including or omitting elements, wherein the conductive element comprises a metal strip.

Example 4 is a circuit, including the subject matter of examples 1-3, including or omitting elements, wherein the matching circuit comprises a resistive element and a reactive element, thereby contributing a complex impedance.

Example 5 is a circuit, including the subject matter of examples 1-4, including or omitting elements, wherein resistive element comprises a resistor and the reactive element comprises an inductor.

Example 6 is a circuit, including the subject matter of examples 1-5, including or omitting elements, wherein the resistive element and the reactive element are connected in parallel.

Example 7 is a circuit, including the subject matter of examples 1-6, including or omitting elements, wherein the impedance provided by the matching circuit is purely resistive.

Example 8 is a circuit, including the subject matter of examples 1-7, including or omitting elements, wherein the impedance provided by the matching circuit is purely reactive.

Example 9 is a circuit, including the subject matter of examples 1-8, including or omitting elements, wherein the partition line circuit is further configured to electromagnetically couple to one or more antennas of the two adjacent antennas, upon excitation of the corresponding antennas, based on the dimension of the conductive element, thereby reducing electromagnetic coupling between the two antennas; and generate a coupled current associated with the one or more antennas within the partition line circuit.

Example 10 is a circuit, including the subject matter of examples 1-9, including or omitting elements, wherein the matching circuit is further configured to reverse a polarity of the coupled current associated with the one or more antennas, by utilizing the impedance associated with the matching circuit, prior to providing the coupled current to the ground circuit, in order to cancel the current due to the one or more antennas in the ground circuit, thereby reducing a current coupling between antenna ports respectively associated with the two adjacent antennas.

Example 11 is an antenna system comprising a first antenna element; a second, different, antenna element; and an antenna isolation circuit located between the first antenna element and the second antenna element, and configured to provide an isolation between the first antenna element and the second antenna element, the antenna isolation circuit comprising a partition line circuit comprising a conductive element; and a matching circuit having a first end and a second end, wherein the matching circuit is coupled to the partition line circuit at the first end and to a common ground circuit at the second end, and wherein the matching circuit is configured to provide an impedance; wherein a dimension of the conductive element and the impedance of the matching circuit are configured to result in the isolation between the first antenna element and the second antenna element.

Element 12 is a system, including the subject matter of example 11, including or omitting elements, wherein the partition line circuit is configured to electromagnetically couple to first antenna element or the second antenna element or both, upon excitation of the corresponding antennas, based on the dimension of the conductive element, thereby reducing electromagnetic coupling between the first antenna element and the second antenna element; and generate a current associated with the first antenna element or the second antenna element or both, based thereon, within the partition line circuit.

Element 13 is a system, including the subject matter of examples 11-12, including or omitting elements, wherein the matching circuit is further configured to reverse a polarity of the current associated with the first antenna element or the second antenna element or both, by utilizing the impedance associated with the matching circuit, prior to providing the current to the ground circuit, in order to cancel the current due to the first antenna element or the second antenna element or both in the ground circuit, thereby reducing a current coupling between a first antenna port and a second antenna port respectively associated with the first antenna element and the second antenna element.

Element 14 is a system, including the subject matter of examples 11-13, including or omitting elements, wherein the first antenna element and the second antenna element have the same frequency range of operation.

Element 15 is a system, including the subject matter of examples 11-14, including or omitting elements, wherein the first antenna element has a first frequency range of operation and the second antenna element has a second, different, frequency range of operation.

Element 16 is a system, including the subject matter of examples 11-15, including or omitting elements, wherein the dimension of the conductive element comprises one or more of a length, width, height, cross-sectional area, shape and orientation of the conductive element.

Element 17 is a system, including the subject matter of examples 11-16, including or omitting elements, wherein the conductive element comprises a metal strip.

Element 18 is a system, including the subject matter of examples 11-17, including or omitting elements, wherein the matching circuit comprises a resistive element that contributes a real part of the impedance and a reactive element that contributes an imaginary part of the impedance.

Element 19 is a system, including the subject matter of examples 11-18, including or omitting elements, wherein the reactive element comprises an inductor.

Example 20 is a method for providing an isolation between two adjacent antennas in a wireless communication device. The method comprises providing an antenna isolation circuit between the two adjacent antennas, the antenna isolation circuit comprising a partition line circuit comprising a conductive element; and a matching circuit having a first end and a second end, wherein the matching circuit is coupled to the partition line circuit at the first end and to a ground circuit at the second end, and wherein the matching circuit is configured to provide an impedance; and configuring a dimension of the conductive element and the impedance of the matching circuit to result in an isolation between the two adjacent antennas.

Example 21 is a method, including the subject matter of example 20, wherein the dimension of the conductive element comprises one or more of a length, width, height, cross-sectional area, shape and orientation of the conductive element.

Example 22 is a method, including the subject matter of examples 20-21, including or omitting elements, wherein the matching circuit comprises a resistive element and a reactive element, thereby contributing a complex impedance.

Example 23 is a method, including the subject matter of examples 20-22, including or omitting elements, wherein resistive element comprises a resistor and the reactive element comprises an inductor.

Example 24 is a method, including the subject matter of examples 20-23, including or omitting elements, wherein the resistive element and the reactive element are connected in parallel.

Example 25 is a method, including the subject matter of examples 20-24, including or omitting elements, wherein the partition line circuit is configured to electromagnetically couple to one or more antennas of the two adjacent antennas, upon excitation of the corresponding antennas, based on the dimension of the conductive element, thereby reducing electromagnetic coupling between the two antennas; and generate a coupled current associated with the one or more antennas within the partition line circuit.

Example 26 is a method, including the subject matter of examples 20-25, including or omitting elements, wherein the matching circuit is further configured to reverse a polarity of the coupled current associated with the one or more antennas, by utilizing the impedance associated with the matching circuit, prior to providing the coupled current to the ground circuit, in order to cancel the current due to the one or more antennas in the ground circuit, thereby reducing a current coupling between antenna ports respectively associated with the two adjacent antennas.

Various illustrative logics, logical blocks, modules, and circuits described in connection with aspects disclosed herein can be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform functions described herein. A general-purpose processor can be a microprocessor, but, in the alternative, processor can be any conventional processor, controller, microcontroller, or state machine.

The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the disclosed subject matter has been described in connection with various embodiments and corresponding Figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

In particular regard to the various functions performed by the above described components (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the disclosure. In addition, while a particular feature may have been disclosed with respect to only one of several implementations, such feature may be combined with one or more other features of the other implementations as may be desired and advantageous for any given or particular application.

What is claimed is:

1. An antenna isolation circuit configured to provide an isolation between two adjacent antennas in a wireless communication device, comprises:

a partition line circuit comprising a conductive element configured to be placed between the two adjacent antennas, and wherein the partition line circuit is configured to:

electromagnetically couple to one or more antennas of the two adjacent antennas, upon excitation of the corresponding antennas, based on a dimension of the conductive element, thereby reducing electromagnetic coupling between the two antennas; and generate a coupled current associated with the one or more antennas within the partition line circuit; and a matching circuit having a first end and a second end, wherein the matching circuit is coupled to the partition line circuit at the first end and to a ground circuit at the second end, and wherein the matching circuit is configured to provide an impedance, and wherein the matching circuit is configured to reverse a polarity of the coupled current associated with the one or more antennas, by utilizing the impedance associated with the matching circuit, in order to cancel the current due to the one or more antennas in the ground circuit, thereby reducing a current coupling between antenna ports respectively associated with the two adjacent antennas.

2. The circuit of claim 1, wherein the dimension of the conductive element comprises one or more of a length, width, height, cross-sectional area, shape and orientation of the conductive element.

3. The circuit of claim 1, wherein the conductive element comprises a metal strip.

4. The circuit of claim 1, wherein the matching circuit comprises a resistive element and a reactive element, thereby contributing a complex impedance.

5. The circuit of claim 4, wherein resistive element comprises a resistor and the reactive element comprises an inductor.

6. The circuit of claim 4, wherein the resistive element and the reactive element are connected in parallel.

7. The circuit of claim 1, wherein the impedance provided by the matching circuit is purely resistive.

8. The circuit of claim 1, wherein the impedance provided by the matching circuit is purely reactive.

9. An antenna system comprising:

a first antenna element;

a second, different, antenna element; and an antenna isolation circuit located between the first antenna element and the second antenna element, and configured to provide an isolation between the first antenna element and the second antenna element, the antenna isolation circuit comprising:

a partition line circuit comprising a conductive element, and wherein the partition line circuit is configured to:

electromagnetically couple to first antenna element or the second antenna element or both, upon excitation of the corresponding antennas, based on a dimension of the conductive element, thereby reducing electromagnetic coupling between the first antenna element and the second antenna element; and generate a coupled current associated with the first antenna element or the second antenna element or both, based thereon, within the partition line circuit; and a matching circuit having a first end and a second end, wherein the matching circuit is coupled to the partition line circuit at the first end and to a common ground circuit at the second end, and wherein the matching circuit is configured to provide an impedance, and wherein the matching circuit is configured to reverse a polarity of the coupled current associated with the first antenna element or the second antenna element or both, by utilizing the impedance associated with the matching circuit, in order to cancel the current due to the first antenna element or the second antenna element or both in the ground circuit, thereby reducing a current coupling between a first antenna port and a second antenna port respectively associated with the first antenna element and the second antenna element.

10. The system of claim 9, wherein the first antenna element and the second antenna element have the same frequency range of operation.

11. The system of claim 9, wherein the first antenna element has a first frequency range of operation and the second antenna element has a second, different, frequency range of operation.

12. The system of claim 9, wherein the dimension of the conductive element comprises one or more of a length, width, height, cross-sectional area, shape and orientation of the conductive element.

13. The system of claim 9, wherein the conductive element comprises a metal strip.

14. The system of claim 9, wherein the matching circuit comprises a resistive element that contributes a real part of the impedance and a reactive element that contributes an imaginary part of the impedance.

15. The system of claim 14, wherein the reactive element comprises an inductor.

16. A method for providing an isolation between two adjacent antennas in a wireless communication device, comprises:

providing an antenna isolation circuit between the two adjacent antennas, the antenna isolation circuit comprising:

a partition line circuit comprising a conductive element, and wherein the partition line circuit is configured to:

electromagnetically couple to first antenna element or the second antenna element or both, upon excitation of the corresponding antennas, based on a dimension of the conductive element, thereby reducing electromagnetic coupling between the first antenna element and the second antenna element; and generate a coupled current associated with the first antenna element or the second antenna element or both, based thereon, within the partition line circuit; and a matching circuit having a first end and a second end, wherein the matching circuit is coupled to the partition line circuit at the first end and to a ground circuit at the second end, and wherein the matching circuit is configured to provide an impedance, and wherein the matching circuit is configured to reverse a polarity of the coupled current associated with the one or more antennas, by utilizing the impedance associated with the matching circuit, in order to cancel the current due to the one or more antennas in the ground circuit, thereby reducing a current coupling between antenna ports respectively associated with the two adjacent antennas.

17. The method of claim 16, wherein the dimension of the conductive element comprises one or more of a length, width, height, cross-sectional area, shape and orientation of the conductive element.

18. The method of claim 16, wherein the matching circuit comprises a resistive element and a reactive element, thereby contributing a complex impedance.

19. The method of claim 18, wherein resistive element comprises a resistor and the reactive element comprises an inductor.

20. The method of claim 18, wherein the resistive element and the reactive element are connected in parallel.

* * * * *